US007744437B2

(12) United States Patent
Sandrin et al.

(10) Patent No.: US 7,744,437 B2
(45) Date of Patent: Jun. 29, 2010

(54) LIFE-SAVING CLOTHING

(76) Inventors: Patrice Sandrin, Kerespert, Plobannelec-Lesconil (FR) 29740; Frederic Osada, 3, Rue du Jeu de Paume, Chalon-sur-Saone (FR) 71100

( * ) Notice: Subject to any disclaimer, the term of this patent is extended or adjusted under 35 U.S.C. 154(b) by 0 days.

(21) Appl. No.: 11/631,865

(22) PCT Filed: Mar. 3, 2005

(86) PCT No.: PCT/FR2005/000565

§ 371 (c)(1),
(2), (4) Date: Jan. 8, 2007

(87) PCT Pub. No.: WO2005/084468

PCT Pub. Date: Sep. 15, 2005

(65) Prior Publication Data

US 2008/0076309 A1 Mar. 27, 2008

(30) Foreign Application Priority Data

Mar. 3, 2004 (FR) ..... 04 02180

(51) Int. Cl.
*B63C 9/08* (2006.01)

(52) U.S. Cl. ..... 441/120

(58) Field of Classification Search ..... 441/88–120
See application file for complete search history.

(56) References Cited

U.S. PATENT DOCUMENTS

| | | | | |
|---|---|---|---|---|
| 2,703,891 | A * | 3/1955 | Mayer | 441/96 |
| 2,869,152 | A | 1/1959 | Anderson | |
| 3,354,480 | A | 11/1967 | Harding et al. | |
| 3,465,375 | A | 9/1969 | Schell | |
| 4,060,867 | A * | 12/1977 | Miller | 441/89 |
| 5,454,744 | A | 10/1995 | Seiler et al. | |
| 6,837,764 | B2 * | 1/2005 | Bradley | 441/106 |

* cited by examiner

*Primary Examiner*—Ed Swinehart
(74) *Attorney, Agent, or Firm*—Young & Thompson

(57) ABSTRACT

Life-saving clothing, in particular for protecting against drowning persons in danger during travelling in water or any other liquid element. The life-saving clothing (1) includes a part encompassing the trunk of a user's body and is characterized in that the part has inflatable floating elements (3) which is made of a non-extensible material and is arranged in such a way that it takes a folded shape in the uninflated state thereof and forms a float around the user's trunk in the inflated state and the clothing (1) is provided with inflating elements (9) for the floating means. In a preferred embodiment, the volume of floating elements (3) is distributed substantially in front of and behind the user. The life-saving clothing (1) ensures the stable position of the user in such a way that the respiratory tract thereof is free.

19 Claims, 5 Drawing Sheets

LIFE-SAVING CLOTHING

FIELD OF THE INVENTION

This present invention concerns a protective garment, intended in particular to prevent the drowning of people in a situation of danger when travelling on water or any other liquid element.

BACKGROUND OF THE INVENTION

We are already familiar with protective clothing used by fishermen, sportsmen, or the emergency services when travelling on water. These garments are generally made from a waterproof material. In order to protect the user as much as possible, there exists protective clothing known as "waders", which take the form of overalls that include trousers and a front and rear trunk protector held on with braces. The trunk panels are located on the chest area of the user, more or less up to the level of the armpits. This garment can include built-in boots. It protects its user as long as the latter is not submerged accidentally in the water or other liquid element. In fact, in the event of a fall or loss of footing by the user, or in the event of a sudden increase in the height of the water, the water will enter inside the protective garment via the upper part of the trunk protection. In the event of an extended loss of footing, and in particular if the user is unconscious, the action of the hydrodynamic forces can frustrate all attempts at swimming that could restore the person to a vertical position and keep him afloat, thus causing the user to drown.

In order to remedy these drawbacks, protective clothing that includes floating resources have been developed. For example, U.S. Pat. No. 3,465,375 describes a safety garment for fishing, in the form of overalls that include a rubber strip inside of the trunk part forming an airbag with the trunk garment, and which inflates to form a waterproof joint between the body of the fisherman and the end of the trunk garment, preventing the water from entering inside in the garment. The inflated airbag also acts as a float. However, with the airbag inflating inside the garment, the float occupies a very limited space which is not adequate to guarantee the stability of the user in water. Moreover, the airbag, once inflated, presses onto the ribcage of the user in order to create the seal, and this hampers the breathing of the user.

U.S. Pat. No. 5,454,744 describes a protective garment in the form of overalls that include, at the level of the trunk garment, an airbag that is more or less flat when it is not inflated, and forming a an annular float when it is inflated, similar to a lifebuoy. This system only prevents the person from sinking. The drawbacks of this system are the same as those encountered with a lifebuoy. Firstly, the effective area presented by the float when inflated is limited by the height of the uninflated airbag surrounding the trunk garment. As a consequence, the inflated volume does not support the head of the user and does not guarantee that the head will be held out of the water. Secondly, the weight of the body pressing onto the inflated airbag deforms it at the level of the support area, resulting in movement of the gas volume distribution into the zone opposite to the support area. This displacement of volume can cause dynamic instability and can unbalance the user. The risk is then that the head of the user is not held out of the water. In particular, if the user is unconscious, he is unable to turn, and will drown, since his respiratory tract is not held clear.

SUMMARY OF THE INVENTION

One of the objectives of this present invention is therefore to overcome these drawbacks by proposing a protective garment which not only prevents the user from drowning but which also ensures that the user will be brought upright so as to protect the respiratory tract, and in particular to assist people who are unconscious.

To this end, and according to this present invention, a protective garment is proposed that has a part surrounding the trunk of its user, which is remarkable in that the said part includes inflatable floating resources that are made of a non-stretch material, and that are arranged to assume a folded shape in the deflated state, and in the inflated state to form a float that extends around the trunk of the user, and in that the said garment includes resources for inflating the said floating resources.

Preferably, the volume of the floating resources is essentially divided between the front and the back of the user.

Since the floating resources provided on the protective garment according to this present invention are made of a non-stretch material, then in the inflated state they form a volume which is sufficiently rigid so as not to deform on the whole under the influence of turbulence in the water (or any other liquid element) or of pressure from the head of the user. Thus, the protective garment according to the invention guarantees the return to the vertical, and the maintenance of the user at the surface of the water, as well as dynamic stability with a vertical component which opposes tilting front, back and sideways, and thus ensuring the restoration of the user to a stable position, in which the respiratory tract is kept clear.

BRIEF DESCRIPTION OF THE DRAWINGS

Other advantages and characteristics will emerge more clearly from the description that follows of different execution variants which are provided by way of non-limiting examples, of a protective garment according to the invention, with reference to the appended drawings in which.

DETAILED DESCRIPTION OF THE PREFERRED EMBODIMENTS

Figure 1:
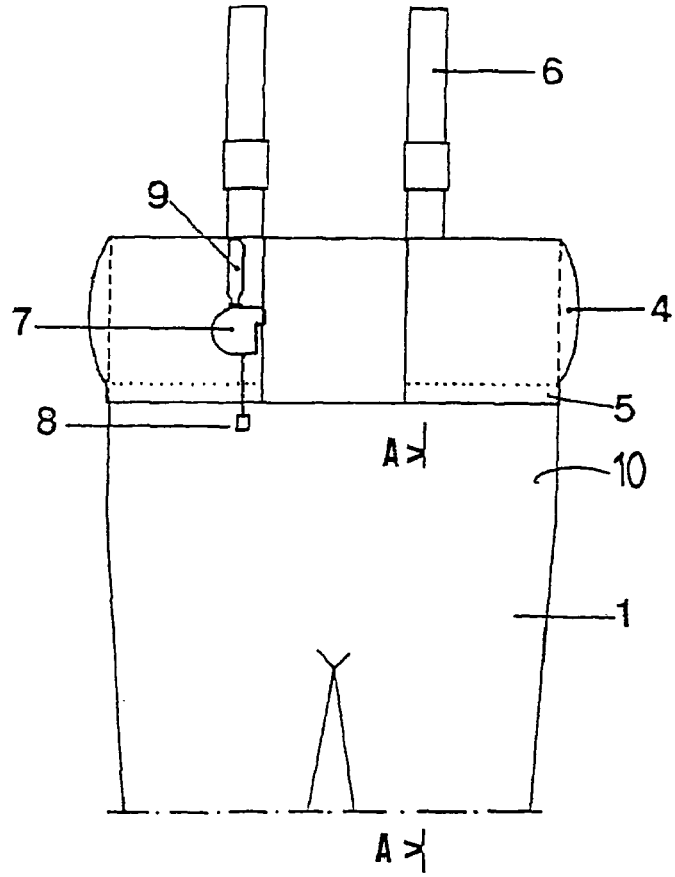
FIG. 1 is a front view of a protective garment according to the invention, with the floating resources in the deflated state.
Figure 2:
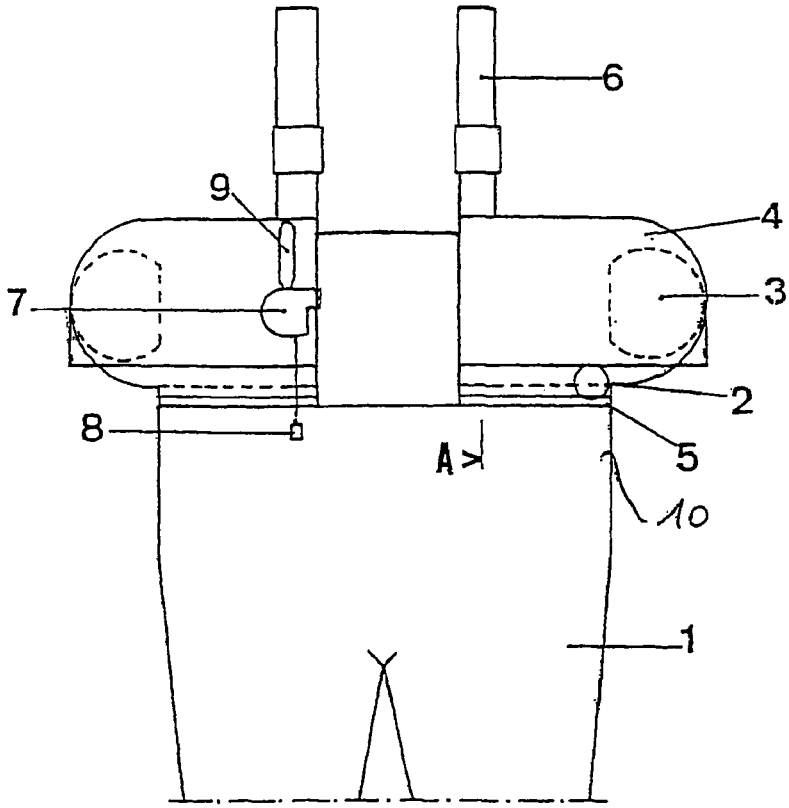
FIG. 2 is a front view of the garment of FIG. 1, with the floating resources in the inflated state.
Figure 3:
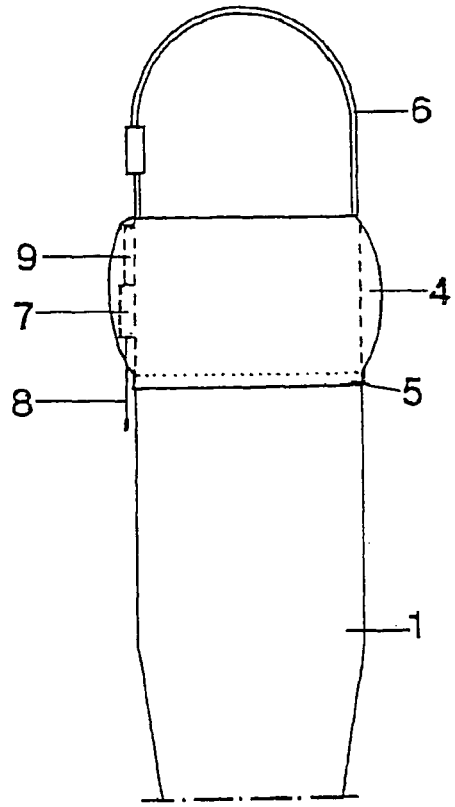
FIG. 3 is a view in profile of the garment of FIG. 1, with the floating resources in the deflated state.
Figure 4:
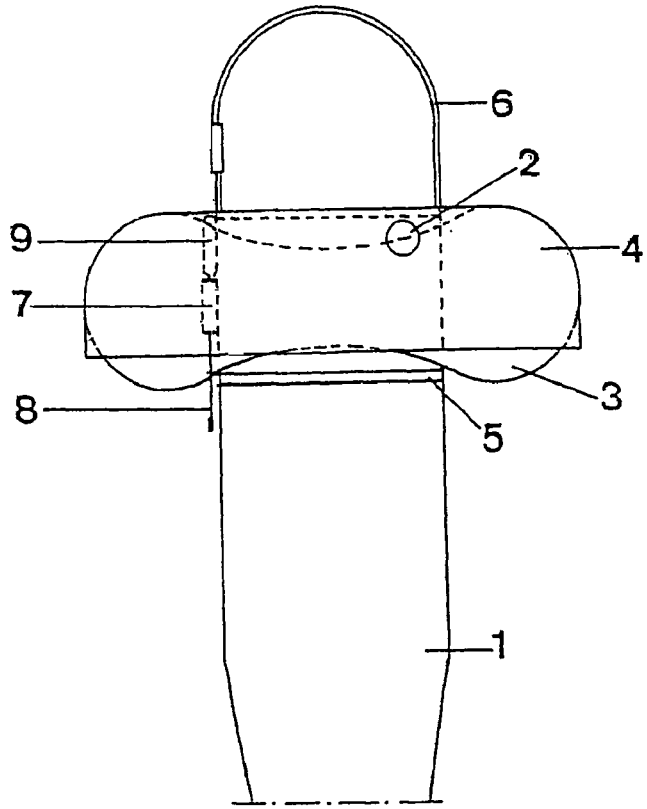
FIG. 4 is a view in profile of the garment of FIG. 1, with the floating resources in the inflated state.

With reference to FIGS. 1 to 4, the protective garment according to this present invention consists of waterproof overalls 1 for sports fishing or for the emergency services, commonly known as "waders". The overalls 1 include braces 6 and trouser legs extended by a trunk garment 10 at front and back which surrounds the trunk of the fisherman. The overalls 1 can include built-in boots (not shown). This garment 1 is made from a waterproof material.

In the method of implementation shown in the figures, in its extension part, the trunk garment 10 has floating resources extending around the front and back of the user's chest area, and is supported by braces 6. The floating resources include an inflatable envelope 3, surrounding the trunk of the user, and made from a non-stretch synthetic material, which is flexible and impermeable to gas and to any liquid element. In contrast to the garments of previous design which employ floats of the airbag type, and therefore made from stretchable material, the invention uses a float that is made from a non-stretch material, such as the coated fabrics that are familiar to the professional designer, and this has the advantage of not deforming generally when forces are applied to its surface.

Figure 5:
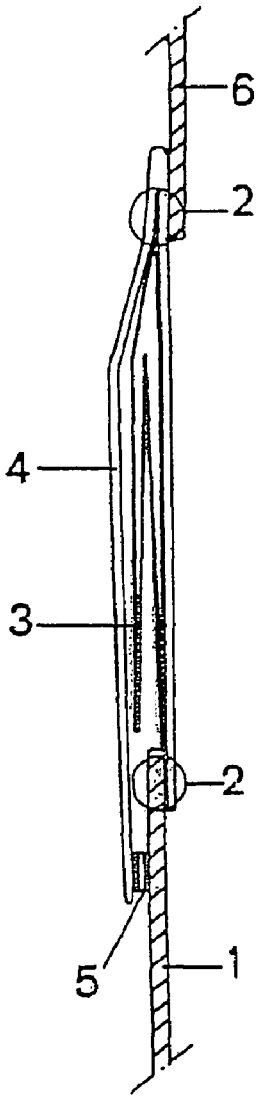
FIG. 5 is a view in section along line A-A of FIG. 1.

With reference to FIG. 5, in its deflated state, the inflatable envelope 3 assumes a form that is folded onto itself, to as to occupy the smallest possible space and not hinder the fisherman.

Figure 6:
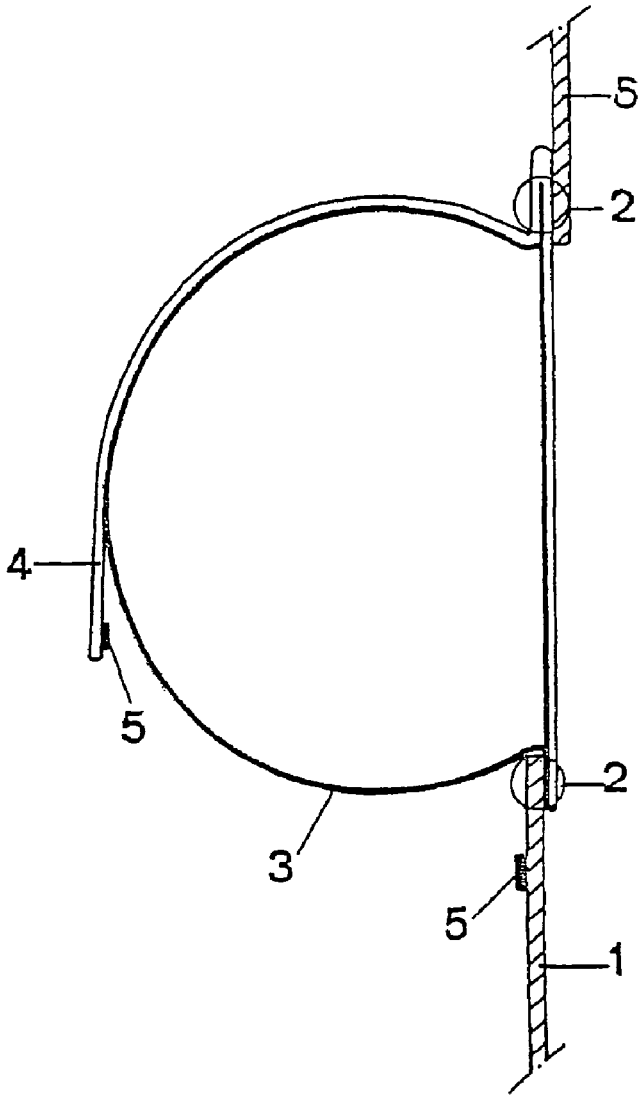
FIG. 6 is a view in section along line A-A of FIG. 2.

The floating resources also include a protective cover 4, in which the inflatable envelope 3 is held folded. The protective cover 4 is made from a material that is resistant to the mechanical stresses experienced by the protective garment during its use. The protective cover 4 includes closure resources 5 of the Velcro® type or any other appropriate system that will allow the release and deployment of the envelope 3 as it inflates, as represented in FIG. 6.

The inflatable envelope 3 and its protective cover 4 are fixed firstly to the trunk garment 10 and secondly to the braces 6 by a permanent connection 2 achieved by glueing, heat-welding, stitching or any other attachment system to suit the materials making up the protective garment. In this variant, the floating resources are incorporated into the upper part of the garment 1 in a non-removable manner.

According to another method of implementation (not shown), the trunk garment 10 is worn in the chest area of the user, more or less up to the level of the armpits, and is supported by braces 6. In this variant, the floating resources can be removable and fixed around the front and rear trunk protector 10 by any removable means of attachment like Velcro®, press studs, zip fasteners, etc.

According to another method of implementation (not shown), the inflatable envelope 3 is made from a material that is resistant to the mechanical stresses experienced by the protective garment during its use, allowing the protective cover to be dispense with.

Since the inflatable envelope 3 as described above is made from a non-stretch material, then in the inflated state, it forms a float with a volume which is sufficiently rigid not to deform generally under the influence of the turbulence in the water or due to pressure from the head of the user. As a consequence, whatever the position of the user and the turbulence of the water, the volume of the float is not deformed in general, thus guaranteeing its stability, opposing any tilting, and enabling the respiratory tract of the user to be held out of the water.

Preferably, the inflatable envelope 3, when inflated, has a volume that is essentially divided between the front and the back of the user.

Figure 7:
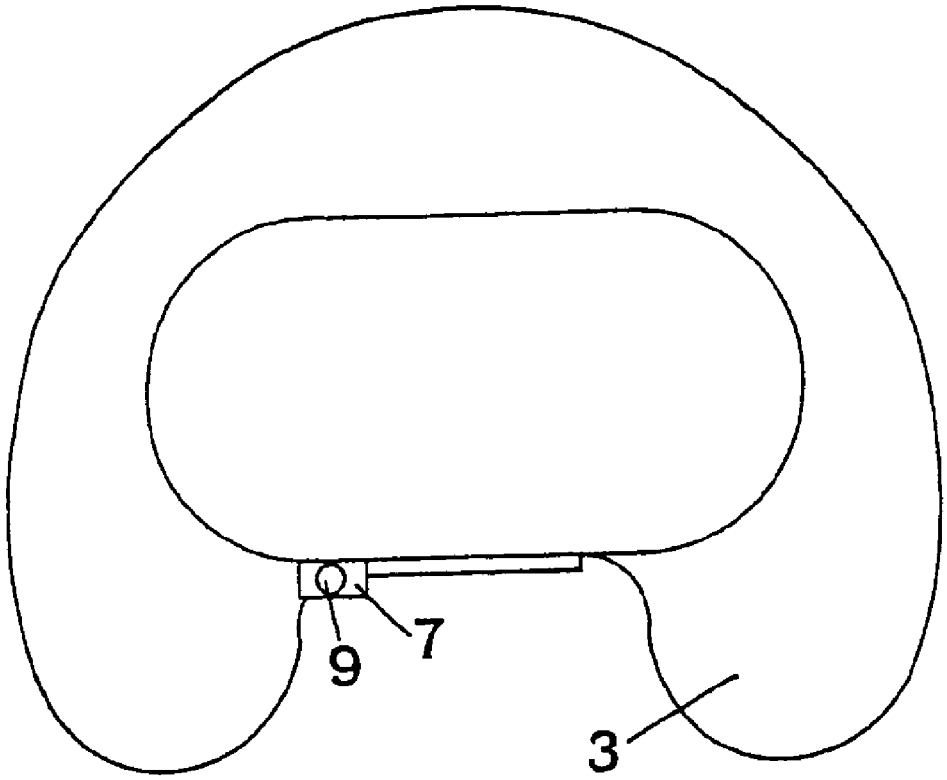
FIG. 7 is a view from above of a variant of the floating resources in the inflated state.

With reference to FIG. 7, the envelope 3, when inflated, assumes more or less the shape of a bean surrounding the trunk of the user, with one back volume and two front volumes that are larger than the lateral volumes. The two front volumes can be sufficiently close to allow the head of the user to rest on the inflated envelope. The volume of the float, which is divided over an open space that is more or less triangular, guarantees stability and opposes tilting so as to hold the respiratory tract out of the water.

Figure 8:
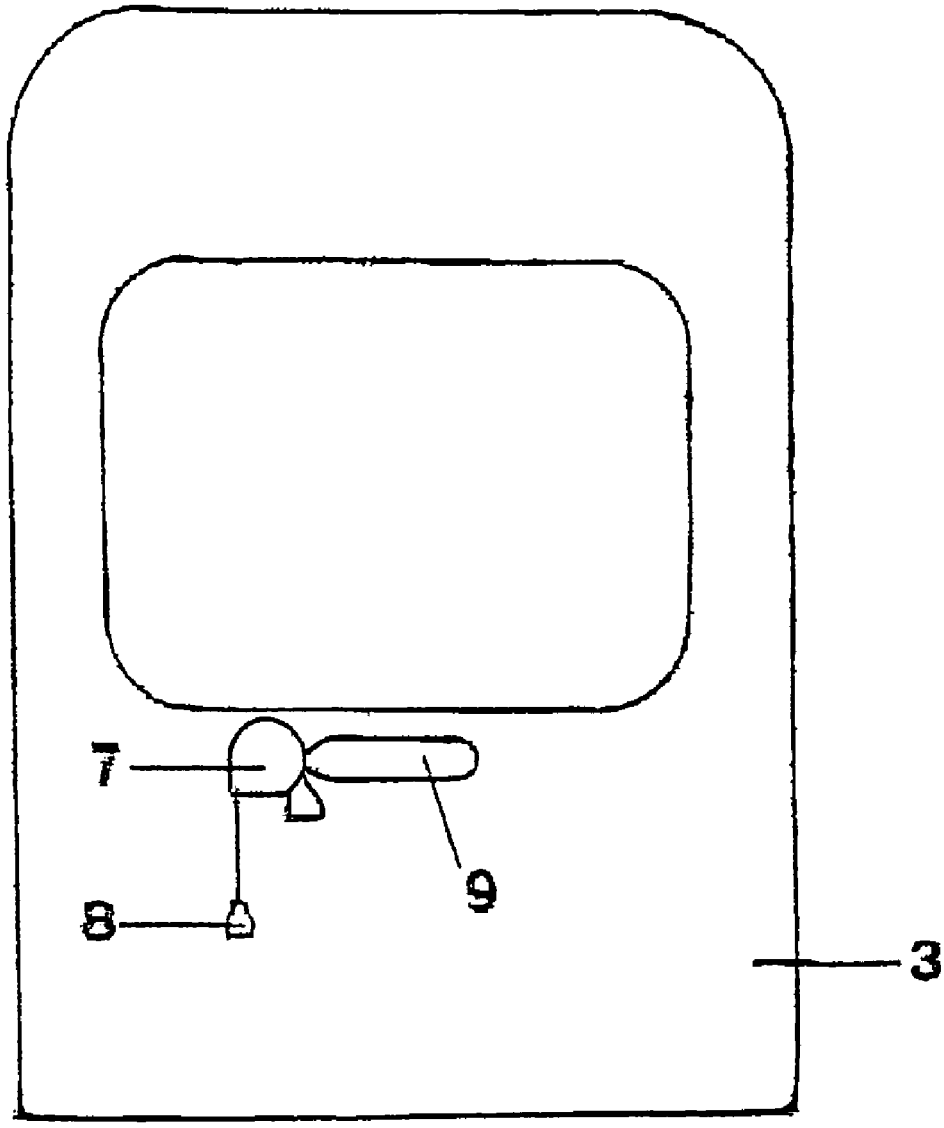
FIG. 8 is a view from above of another variant of the floating resources in the inflated state.

With reference to FIG. 8, the envelope 3 assumes a more or less rectangular shape, with a central opening for passage of the trunk of the user, with the volumes of the envelope 3, once inflated, being essentially divided between the front and the back of the user. The narrower side volumes are positioned more or less under the armpits, and in particular leave the arms of the user free, either for swimming or for performing any operation the might serve to get the individual out of the situation. In this configuration, the volumes are divided essentially between the front and the back of the user during the inflation of the envelope 3, which naturally stabilises the float and does not compress the float against the trunk of the user.

The means employed to inflate the floating resources include a $CO_2$ inflation cartridge 9 operated by a percussion device 7 to release the gas into the envelope 3. The cartridge 9 is equipped with a manual or automatic triggering device. The manual triggering device includes a cord 8 that operates the percussion device 7 of the cartridge 9. The automatic triggering device includes a pressure-operated system built into the percussion device 7 of the cartridge 9. The automatic device can be preset so that triggering of the inflation takes place on total immersion in a depth of liquid around 10 cm.

The inflation resources are preferably placed on the front of the protective garment, so as to be easy to reach with either hand of the user.

It is very obvious that the protective garment according to the invention is not limited to the waterproof garment for fishing, of the "waders" type, as described above, and that the examples provided above are only one particular illustration, which is in no way limiting in relation to the areas of application of the invention.

The invention claimed is:

1. A protective pant having legs and one part configured to surround a chest of a user, wherein said one part includes an inflatable floating element made of a non-stretch material, and arranged to assume a folded shape in a deflated state, and in an inflated state, to form a float extending around the chest of the user, wherein said pant includes a member to inflate said floating element, wherein the floating element is sufficiently rigid to substantially prevent deformation when forces are applied to its surface, and wherein, as seen from above, the floating element has a front portion, a rear portion and a side portion, a width of the side portion is narrower than a width of the front portion and the rear portion.

2. The protective pant according to claim 1, wherein the volume of the floating element in the inflated state, is essentially divided between the front and the back of the user.

3. The protective pant according to claim 1, wherein the floating element includes an inflatable envelope that is folded onto itself in the deflated state.

4. The protective pant according to claim 1, wherein the floating element is incorporated into the pant.

5. The protective pant according to claim 1, wherein the floating element is removable.

6. The protective pant according to claim 1, wherein the member for inflating the floating element includes a $CO_2$ inflation cartridge equipped with a manual triggering device.

7. The protective pant according to claim 1, wherein the member for inflating the floating element includes a $CO_2$ inflation cartridge equipped with an automatic triggering device.

8. The protective pant according to claim 1, wherein the floating element includes a protective cover.

9. The protective according to claim 8, wherein said protective cover is equipped with a closure element arranged to allow deployment of the floating element as the floating element is inflated.

10. The protective pant according to claim 1, wherein the non-stretch material is a synthetic material.

11. A protective pant, comprising:

legs; and one part configured to surround a chest of a user, wherein said one part includes an inflatable floating element made of a non-stretch material, and arranged to assume a folded shape in a deflated state, and in an inflated state, to form a float extending around the chest of the user, and said pant includes a member to inflate the floating element, the floating element being sufficiently rigid to substantially prevent deformation when forces are applied to its surface, and, as seen from above, the floating element has a front portion, a rear portion and side portions, the side portions having a width narrower than a width of the front portion and the rear portion.

12. The protective pant according to claim 11, wherein the non-stretch material is a synthetic material.

13. The protective pant according to claim 11, wherein the volume of the floating element in the inflated state, is essentially divided between a front and a back of the user.

14. The protective pant according to claim 11, wherein the floating element includes an inflatable envelope that is folded onto itself in the deflated state.

15. The protective pant according to claim 11, wherein the member for inflating the floating element includes a $CO_2$ inflation cartridge equipped with a manual triggering device.

16. The protective pant according to claim 11, wherein the member for inflating the floating element includes a $CO_2$ inflation cartridge equipped with an automatic triggering device.

17. The protective pant according to claim 11, wherein the floating element includes a protective cover.

18. The protective according to claim 17, wherein said protective cover is equipped with a closure element arranged to allow deployment of the floating element as the floating element is inflated.

19. A protective pant, comprising:

legs; and one part configured to surround a chest of a user, wherein said one part includes an inflatable floating element made of a synthetic non-stretch material, and arranged to assume a folded shape in a deflated state, and in an inflated state, to form a float extending around the chest of the user, and said pant includes a member to inflate said floating element, the floating element being sufficiently rigid not to deform generally under the influence of water turbulence or due to pressure from a head of the user, and as seen from above, the floating element has a pair of front portions, a rear portion and side portions, the side portions having a width narrower than a width of the front portions and the rear portion.

* * * * *